US006166705A

United States Patent [19]

Mast et al.

[11] Patent Number: 6,166,705

[45] Date of Patent: Dec. 26, 2000

[54] MULTI TITLE-CONFIGURED PHASED ARRAY ANTENNA ARCHITECTURE

[75] Inventors: Alan W. Mast, Indialantic; John W. Shipley, Sebastian; Douglas E. Heckaman, Indialantic; Walter M. Whybrew, Palm Bay, all of Fla.

[73] Assignee: Harris Corporation, Melbourne, Fla.

[21] Appl. No.: 09/357,680

[22] Filed: Jul. 20, 1999

[51] Int. Cl.[7] ..... H01Q 21/00

[52] U.S. Cl. ..... 343/853; 343/700 MS; 342/372; 342/375

[58] Field of Search ..... 343/700 MS, 850, 343/853, 909, 893; 342/361, 368, 372, 375

[56] References Cited

U.S. PATENT DOCUMENTS 5,372,872 12/1994 Funada et al. ..... 428/210
5,539,415 7/1996 Metzen et al. ..... 343/700 MS
5,561,434 10/1996 Yamazaki ..... 343/700 MS
5,854,607 12/1998 Kinghorn ..... 343/853

*Primary Examiner*—Tan Ho
*Attorney, Agent, or Firm*—Allen, Dyer, Doppelt, Milbrath & Gilchrist, P.A.

[57] ABSTRACT

A multi-tile configured, two-dimensional phased array antenna architecture is configured of an gridwork of sub-array 'tiles', each of which contains a mechanically integrated and RF-integrated antenna elements and RF interface components therefor. Each tile is formed of a multilayer printed wiring board and supports a sub-array of antenna elements and their associated RF circuits, so that the tile itself is effectively an operative phased-array antenna. The gridwork supports the sub-array tiles in sealed engagement with the framework, whereby associated RF networks components at rear sides of the tiles are protected against the free space environment to which the antenna elements on front faces of the tiles are exposed. Each RF interface network contains signal processing circuitry for controlling the operation of a respective one or a set of the antenna elements on the front side of the tile.

21 Claims, 4 Drawing Sheets

MULTI TITLE-CONFIGURED PHASED ARRAY ANTENNA ARCHITECTURE

FIELD OF THE INVENTION

The present invention relates in general to communication systems and components, and is particularly directed to a new and improved phased array antenna architecture, configured of an array of multilayer printed circuit wiring board-based tiles. Opposite sides of a respective tile respectively support plural antenna elements and associated RF signal processing interface networks therefor, that are coupled to one another by way of RF feeds through the multilayer printed circuit wiring board. The array also contains power and control units mounted to the sides of the tiles containing the RF signal processing interface networks.

BACKGROUND OF THE INVENTION

Conventional phased array antenna structures, an example of which is described in U.S. Pat. No. 5,206,655, employ relatively complex electrical and mechanical structures, that contain diverse types of individually packaged RF modules, including those housing the antenna radiator element, and associated RF electronics, power supplies, control processor units and RF distribution circuits. As these modules are typically assembled in honeycomb or mechanically layered architectures, they require large numbers of different types of cabling and interconnects, which may entail the use of thousands of ribbon bond connections for large scale applications. Such complexities of structural design and assembly not only make these systems expensive to manufacture, but result in phased array antenna architectures that have a relatively large size and weight—constituting a substantial payload penalty for airborne and spaceborne applications.

SUMMARY OF THE INVENTION

In accordance with the present invention, the above described weight and cost drawbacks of conventional phased array antenna designs are substantially reduced by a multi-tile configured, two-dimensional phased array architecture configured of a gridwork of sub-array tiles, each of which contains a mechanically integrated and RF-integrated antenna elements and RF interface components therefor. Because each tile of the overall array provides both mechanical and electrical support for a sub-array of antenna elements and their associated RF circuits, the tile itself is effectively an operative phased-array antenna. This novel architecture is extremely flexible and is not limited by frequency, electrical scan requirements, antenna element array type, or the RF components used.

The two dimensional tile-supporting gridwork is configured as a generally planar frame having a two-dimensional matrix of generally polygonally shaped pockets, that are sized to receive and support in a sealed engagement respective ones of a plurality of sub-array 'tiles'. Because the pockets of the supporting framework allow the sub-array tiles to be mounted in sealed engagement with the framework, the components of associated RF networks components at rear sides of the tiles are inherently protected against the free space environment to which the antenna elements on front faces of the tiles are exposed. Each RF interface network contains signal processing circuitry for controlling the operation of a respective one or a set of the antenna elements on the front side of the tile.

A plurality of power supply and control units are supported at the back sides of a plurality of tiles of the array. A respective power supply and control unit contains power supply circuitry for supplying DC power to the interface circuits of multiple tiles of the array, a supervisory microcontroller that is programmed to control the operation of sub-array tiles, and RF distribution networks. Connectivity between each power and control unit and the tiles it controls and powers may be provided by ribbon cables, and coaxial cables for RF distribution, connected therebetween.

An alternative configuration of the connection scheme employs a frequency multiplexed cable, wherein respective DC power, control signals and RF signals are carried over a single transmission cable. Each has an allotted frequency spectrum on the cable, and filtering among the respective DC power, control and RF signals takes place on tile.

A first embodiment of a tile is formed of a laminate structure containing a generally planar metallic layer and a multilayer printed wiring board. An outer face of the metallic support layer provides a support surface for the sub-array of antenna elements. RF-connectivity between the antenna elements and RF coupling ports of associated RF interface circuits on the rear face of the printed wiring board is directly provided by means of a conductive pin that passes through a generally cylindrical aperture in the tile. This RF connectivity pin is preferably encapsulated in a dielectric medium, such as a glass bead, that fills the aperture and provides both mechanical stabilization and a matched impedance RF transmission path between the antenna element and an RF output amplifier chip that is surface-mounted to an outer RF microstrip layer of the RF interface circuit.

The laminate structure of a second embodiment of a tile is comprised of a multilayer printed wiring board, without a metallic support layer. RF-connectivity between the antenna elements and their associated RF interface circuits is provided by means of a plated through holes in the multilayer printed wiring board.

Alternative configurations of each of the first and second embodiments include placing RF signal processing components on the same face of the tile as the antenna elements. These RF components may be connected to RF components on the other side of the tile using RF links through the printed wiring board, in effectively the same manner that the antenna elements are connected therethrough. The alternative configuration can improve performance through the use of shorter length RF pathways to the antenna elements, and also allows for higher packaging density.

DETAILED DESCRIPTION

Figure 1:
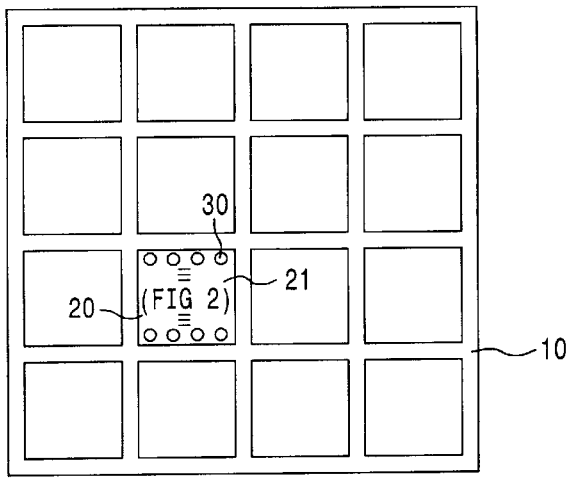
FIG. 1 is a diagrammatic front view of a sub-array tile based, electronically scanned phased array antenna of the present invention.
Figure 2:
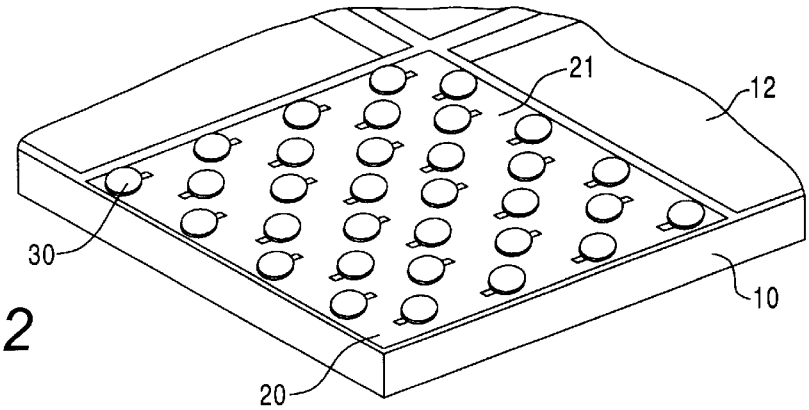
FIG. 2 is a partial perspective view of FIG. 1.

FIGS. 1–9 diagrammatically illustrate the architecture of the sub-array tile based, electronically scanned phased array antenna in accordance with the present invention. As shown in FIGS. 1 and 2, the antenna array comprises a generally planar or flat grid-configured support member, such as a metallic (e.g., aluminum) frame 10, having a two-dimensional matrix of generally polygonally shaped (e.g., square) pockets 12. The frame pockets 12 of the supporting framework are sized to receive and support in a sealed engagement respective ones of a plurality of sub-array 'tiles' 20, front sides 21 of which contain a plurality of antenna elements 30, and which are configured to conform with the geometries of the pockets 12. For purposes of illustrating a reduced complexity example, the gridwork geometry of the tile-supporting frame 10 is shown as defining a 4×4 array of generally square shaped pockets. It is to be understood, however, that the gridwork geometry is not limited to defining pockets of a particular shape or number.

Because the pockets of the framework 10 allow sub-array tiles 20 to be mounted in sealed engagement with framework 10, the components of associated RF networks components 40 mounted to rear sides 23 of the tiles are inherently protected or sealed against the free space environment to which the antenna elements are exposed. Also, this two dimensional gridwork support structure facilitates repair and replacement of individual sub-array tiles.

As shown in the front view of FIG. 1, and the partial perspective view of FIG. 2, a plurality or sub-array of free space RF energy-coupling (emitting—receiving) antenna elements 30 are distributed on a first, front side or face 21 of a respective sub-array tile 20. In a complementary fashion, as shown in the overall tile matrix rear view of FIG. 3, the side view of FIG. 4, and the rear view of a respective tile in FIG. 5, a plurality of RF interface networks 40 may be formed on a second, back side or face 23 of a respective sub-array tile 20. Each RF interface network 40 is associated with and contains signal processing circuitry for controlling the operation of a respective one or set of the antenna elements 30 on the front side of the tile.

Figure 4:
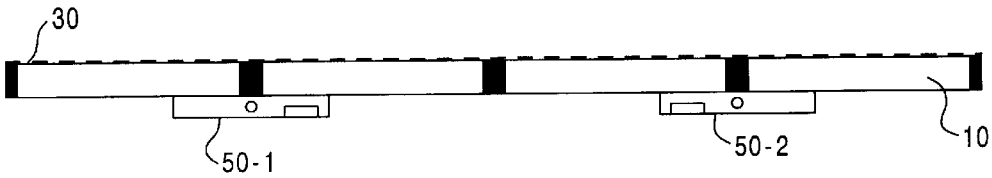
FIG. 4 is a diagrammatic side view of the phased array antenna of FIG. 1.
Figure 3:
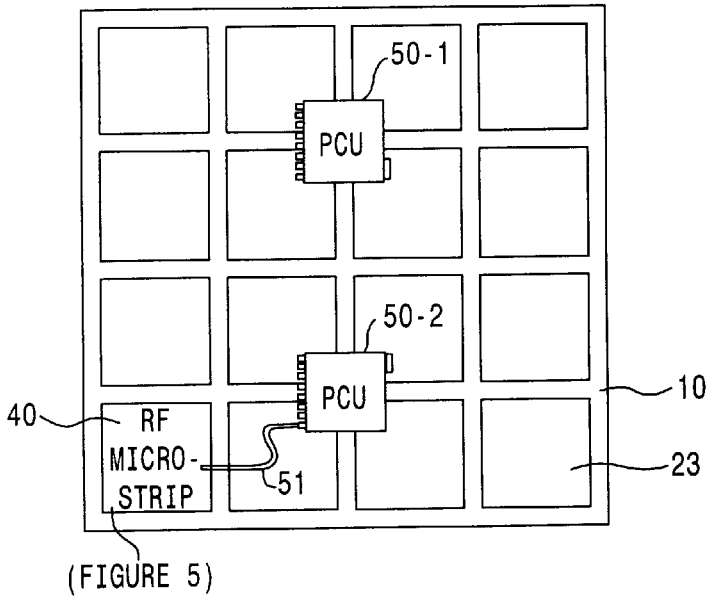
FIG. 3 is a diagrammatic rear view of the phased array antenna of FIG. 1.

Also shown in FIGS. 3 and 4 are a plurality of power supply and control units 50-1 and 50-2, mounted to the back sides of a plurality of tiles (e.g., four tiles per power and control unit, as shown). A respective power supply and control unit 50 contains power supply circuitry for supplying DC power to interface circuits 40 of multiple tiles of the array, a supervisory microcontroller programmed to control the operation of multiple sub-array tiles, and the RF distribution networks thereof.

As pointed out briefly above, connectivity between each power and control unit 50 and the tiles it controls and powers may be provided by ribbon cables and RF coaxial cables 51 connected therebetween. An alternative connection scheme to be described below with reference to FIG. 8, employs a frequency multiplexed cable, wherein respective DC power, control signals and RF signals are carried over a single transmission cable. Each has an allotted frequency spectrum on the cable, and filtering among the respective DC power, control and RF signals takes place on tile.

Figure 6:
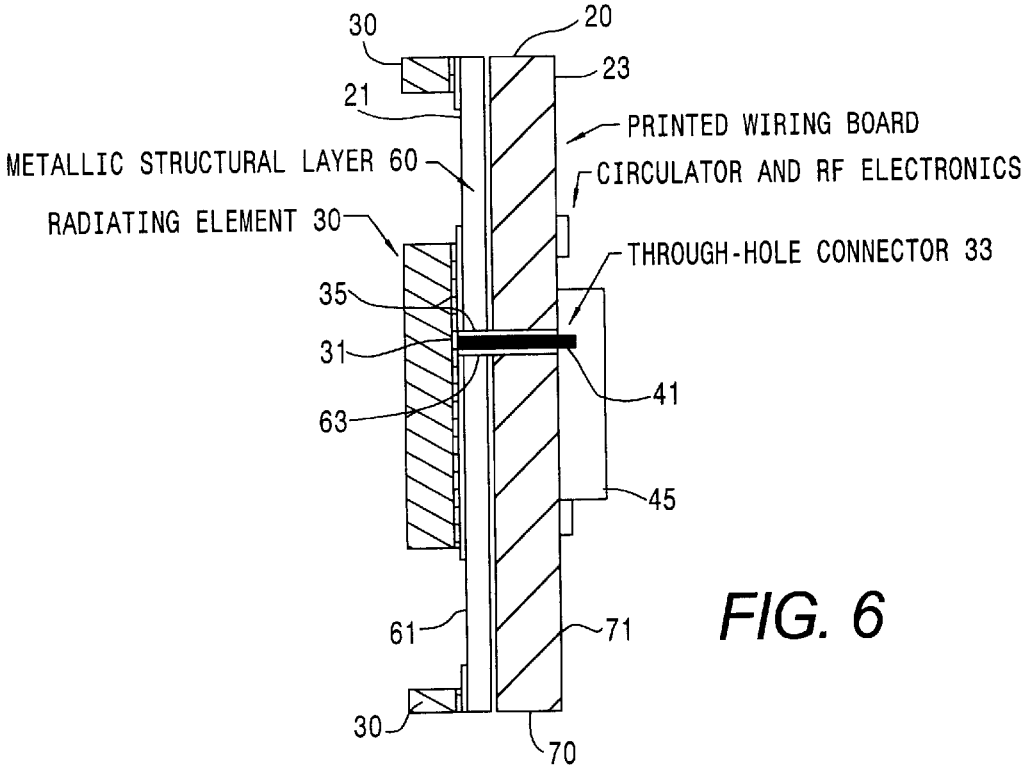
FIG. 6 is a partial side view of the laminate structure of a first embodiment of a respective tile of the phased array antenna of FIG. 1.

FIG. 6 is a diagrammatic partial side view showing the laminate structure of a first embodiment of a respective tile 20, and the manner in which RF coupling between an antenna element 30 on the front face 21 of the tile and its associated RF interface circuit 40 on the tile's rear face 23 is directly coupled through the tile. In accordance with this first embodiment, a tile is comprised of a laminate arrangement of a generally planar metallic support plate 60, and a multilayer printed wiring board 70. The multilayer printed wiring board 70 may comprise a laminated arrangement of alternating dielectric (e.g. co-fired ceramic) layers, and conductive stripline layers patterned to define RF filtering and signal distribution circuitry on a rear face 71 of the board 70, and an internal interconnect structure therefor. RF signal distribution and filtering stripline circuit patterns may also be provided on one or more interior layers of the printed wiring board laminate structure.

As a non-limiting example, the multilayer printed wiring board 70 may be of the type described in the U.S. Pat. No. 5,384,555 to Wilson et al, entitled "Combined RF and Digital/DC Signalling Interconnect Laminate," assigned to the assignee of the present application and the disclosure of which is incorporated herein. An outer face 61 of the metallic support layer 60 provides the mounting/support surface for the sub-array of (radiating) antenna elements 30. As a non-limiting example, antenna elements 30 may be configured as stacked patch antennas, such as those described in the U.S. Pat. No. 5,874,919 to Rawnick et al, entitled: "Stub-Tuned, Proximity-Fed, Stacked Patch Antenna," assigned to the assignee of the present application and the disclosure of which is incorporated herein.

RF-connectivity between a feed port 31 of the antenna element 30 and an RF coupling port 41 of its associated RF interface circuit 40 formed on the rear face 71 of the multilayer printed wiring board 70 is provided by means of a conductive (e.g., gold) pin 33, that passes through a generally cylindrical aperture 63 in the metallic support layer 60 and the multilayer printed wiring board 70. The RF transmission pin 33 may be surrounded by or encapsulated in a dielectric medium, such as a glass bead 35, that fills the aperture 63 and provides both mechanical stabilization and a matched impedance RF transmission line path between the antenna element 30 and RF circuitry, such as an RF output amplifier chip 45, surface-mounted to an outer RF microstrip layer of the RF interface circuit 40.

Such a direct, shortest distance RF connection between an antenna element 30 on the front side of the tile and its associated RF interface circuit 40 on the rear side of the tile provides a substantial increase in power efficiency in transmit mode, and also decreases the noise figure of a receive array. Surface-mounting the RF electronic components to the rear sides 23 of the tiles 20 eliminates the need for complex, time consuming and expensive wire-bonding employed for individual mechanically parasitic phased array modules and panels of conventional phased array systems. It also reduces substantially the size and weight penalty associated with additional connectivity material. Moreover, this approach is not limited to surface-mount packaged components, and may include chip-on-board and flip-chip technology.

As pointed out above, an RF microstrip layer formed on the rear face and/or interior layers of the multilayer printed wiring board 70 may be selectively etched to realize various components of an RF signal coupling network, such as but not limited to filters, power dividers, circulators and the like, to which one or more active RF circuit devices and millimeter wave, microwave integrated circuit (MMIC) signal processing circuits therefor, such as RF power amplifiers, multiplexer units, etc. are mechanically and electrically connected (e.g., using flip-chip or other surface mount configurations).

Figure 7:
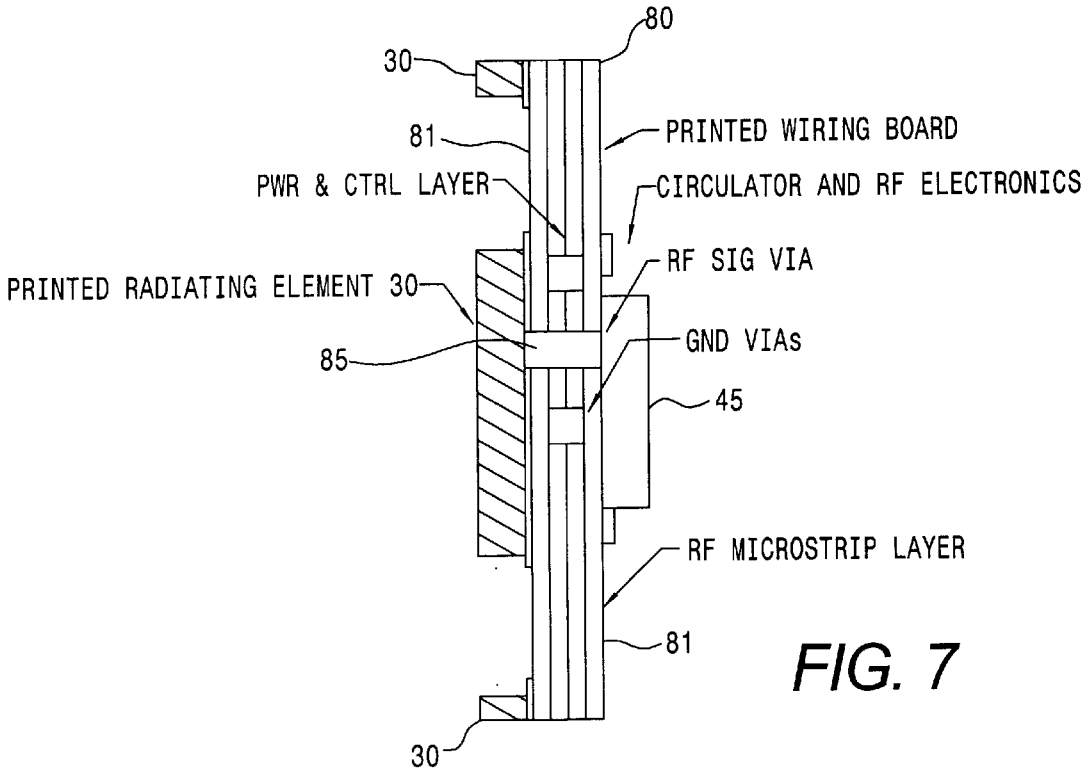
FIG. 7 is a partial side view of the laminate structure of a second embodiment of a respective tile of the phased array antenna of FIG. 1.

The laminate structure of a second embodiment of a respective tile, and the manner in which an antenna element 30 on the front face 21 of the tile is coupled through the tile to an associated RF interface circuit 40 on the tile's rear face 23 is shown diagrammatically in the partial side view of FIG. 7. In the second embodiment, the mechanical strength and electrical interconnectivity (including control signals and DC power distribution) of the tile are provided by a multilayer printed wiring board 80 of the type described in the above-referenced Wilson et al patent.

A first face 81 of the board 80 provides a mounting and support surface for the sub-array of (radiating) antenna elements 30. As in the first embodiment, each antenna element 30 may be configured as a stacked patch antenna described in the Rawnick et al U.S. Pat. No. 5,874,919. In the second embodiment, RF-connectivity between feed ports of the antenna elements 30 and RF coupling ports of their associated RF interface circuit devices 45 formed in an RF microstrip layer on the rear side 81 or interior layers of the printed wiring board 80 is provided by means of plated through holes 85 in the multilayer printed wiring board 80.

As pointed out briefly above, connectivity between each power and control unit and its associated tiles may be provided by ribbon cables and RF coaxial cables connected therebetween. An alternative DC-powering, control and RF distribution signal connection scheme employs a single, frequency multiplexed cable, that transports DC power, control signals and RF signals in respectively allotted portions of the frequency spectrum, with filtering among these three components taking place on the tile proper, as shown diagrammatically in FIG. 8.

Figure 5:
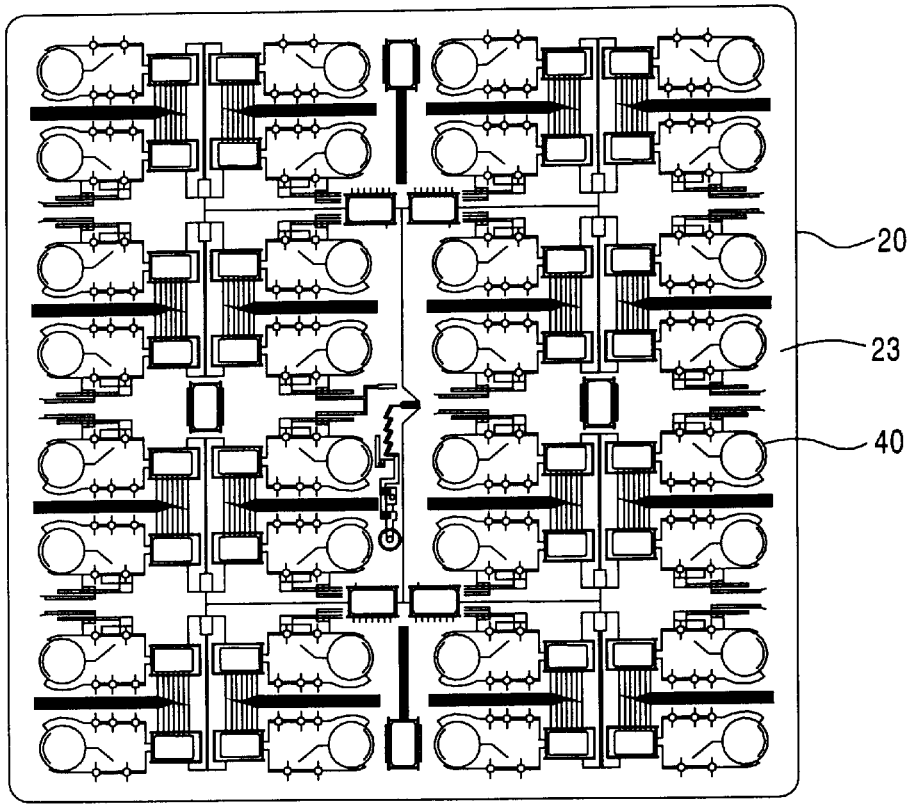
FIG. 5 is a rear view of a respective tile of the phased array antenna of FIG. 1.
Figure 8:
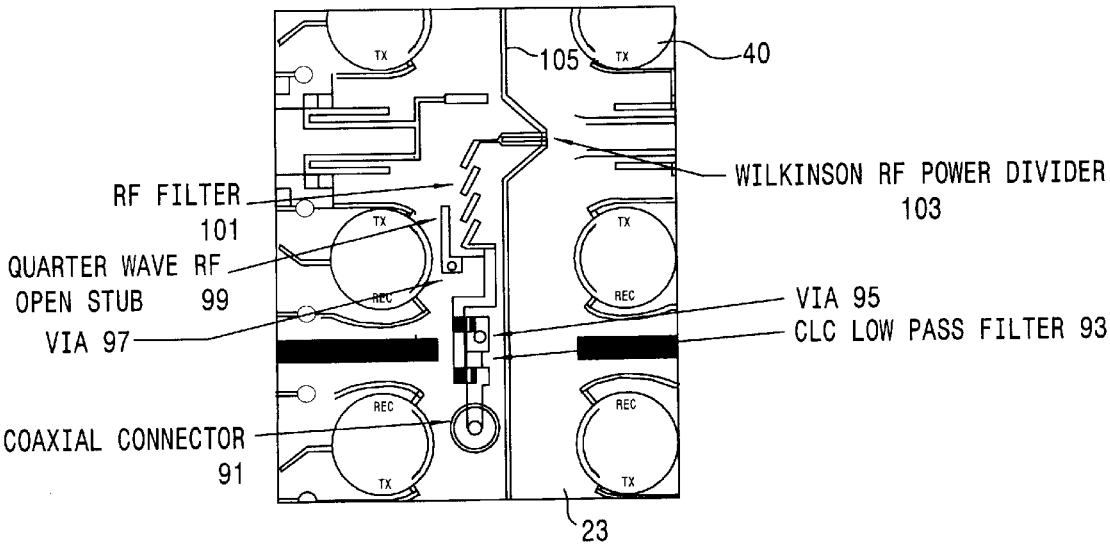
FIG. 8 is a partial enlarged rear view of a respective tile of the phased array antenna of FIG. 1.
Figure 9:
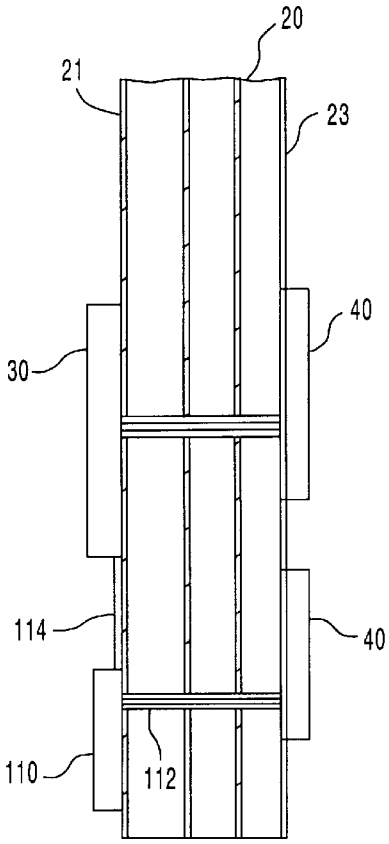
FIG. 9 is a partial diagrammatic side view of a respective tile of the phased array antenna of FIG. 1, showing RF components mounted alongside antenna elements.

More particularly, FIG. 8 shows an enlarged portion of the rear view of a respective tile of FIG. 5, having a coaxial connector 91 to which the frequency multiplexed coaxial cable from a power and control unit is connected. The coaxial connector 91 is coupled through a capacitor and inductor configured low pass filter 93 to a plated via 95, through which a filtered-out DC voltage is coupled to the power distribution conductors of the printed wiring board.

The output of the coaxial connector 91 is further coupled to a plated via 97, to which a quarter wave RF open tuning stub 99 is connected. The RF open tuning stub 99 removes the RF signals, so that plated via 97 may supply the control signals to the control signal distribution portion of the printed wiring board. The coaxial connector 91 is additionally coupled to an RF high pass filter 101, to which a Wilkinson power divider 103 is connected. The output of the Wilkinson power divider 103 is coupled to a section of RF stripline 105, to which RF components are connected.

As noted earlier, alternative configurations of the printed wiring board-based tiles include placing RF signal processing components on the same face of the tile as the antenna elements. This is diagrammatically illustrated in the side view of FIG. 9, which shows RF components 110 mounted on the front side 21 of a tile adjacent to the antenna elements 30. These front side-mounted RF components 110 may be connected to the RF components 40 on the rear side 23 of the tile via RF links 112 through the printed wiring board, in effectively the same manner that the antenna elements are connected therethrough, as described above. This alternative front side mounting of RF components can improve performance through the use of shorter length RF pathways 114 to the antenna elements 30, and also allows for higher packaging density, as described above.

As will be appreciated from the foregoing description, substantial weight and cost of manufacture shortcomings of conventional discrete module-based phased array antenna designs are substantially reduced by a multi-tile configured architecture, in which a respective sub-array tile contains mechanically integrated and RF-integrated antenna elements and RF interface components. Not only does such a tile-based architecture facilitates shortest distance connections between antenna elements and their RF feed circuit, it provides a substantial increase in power efficiency in transmit mode, and decreases the noise figure of a receive array.

Also, surface-mounting the RF electronic components to the rear sides of the tiles eliminates the need for complex, time consuming and expensive wire-bonding employed for individual mechanically parasitic, phased array modules of conventional phased array systems substantially reduces the size and weight penalty associated with this additional connectivity material, and provides protection for the components of associated RF networks components at rear sides of the tiles are inherently protected against the free space environment to which the antenna elements on front faces of the tiles are exposed.

While we have shown and described several embodiments in accordance with the present invention, it is to be understood that the same is not limited thereto but is susceptible to numerous changes and modifications as known to a person skilled in the art, and we therefore do not wish to be limited to the details shown and described herein, but intend to cover all such changes and modifications as are obvious to one of ordinary skill in the art.

What is claimed:

1. A phased array antenna architecture comprising:

a plurality of phased array antenna tiles, a respective phased array antenna tile including a multilayer printed circuit wiring board containing a laminate of interconnect layers, including control signal and DC voltage distribution conductors that provide control signal interconnectivity and DC power distribution for antenna and RF signal processing circuit devices of said respective phased array antenna tile, interposed between first and second opposite sides of said multilayer printed circuit wiring board, a plurality of signal processing interface networks including RF microstrip networks distributed on said first side of said multilayer printed circuit wiring board, a plurality of RF signal processing circuit devices mounted to and connected by said plurality of signal processing interface networks distributed on said first side of said multilayer printed circuit wiring board to said control signal and DC voltage distribution conductors of said laminate of interconnect layers, and a plurality of antenna elements distributed over said second side of said multilayer printed circuit wiring board, and being coupled through said multilayer printed circuit wiring board to associated ones of said plurality of RF signal processing circuit devices mounted to said signal processing interface networks distributed on said first side of said multilayer printed circuit wiring board; and a support structure for supporting said plurality of phased array antenna tiles.

2. A phased array antenna architecture according to claim 1, wherein said support structure is configured to support said plurality of phased array antenna tiles in an array configuration, and such that said signal processing interface networks distributed on said first side of said multilayer printed circuit wiring board are effectively protected from the environment to which said plurality of antenna elements are exposed.

3. A phased array antenna architecture according to claim 1, further including signal processing interface networks distributed on said second side of said multilayer printed circuit wiring board.

4. A phased array antenna architecture according to claim 1, further including at least one power and control unit supported at first sides of multilayer printed circuit wiring boards of said plurality of phased array antenna tiles, and being operative to supply power to and control the operation of said plurality of phased array antenna tiles.

5. A phased array antenna architecture according to claim 4, wherein said at least one power and control unit is operative to supply power, control signals and RF signals to said tiles.

6. A phased array antenna architecture according to claim 5, wherein said at least one power and control unit is operative to supply said power, control signals and RF signals over a common transmission link, and wherein said plurality of signal processing interface networks are configured to filter out and supply said power, control signals and RF signals to said tiles.

7. A phased array antenna architecture according to claim 1, wherein said laminate of interconnect layers interposed between first and second opposite sides of said multilayer printed circuit wiring board includes RF distribution networks and filtering conductive patterns.

8. A phased array antenna architecture according to claim 1, wherein said RF signal processing circuit devices include unpackaged semiconductor circuit die surface-mounted to said plurality of signal processing interface networks distributed on said first side of said printed wiring board.

9. A phased array antenna architecture according to claim 1, wherein said RF signal processing circuit devices include unpackaged semiconductor circuit die having wire-bond connections to said plurality of signal processing interface networks distributed on said first side of said printed wiring board.

10. A phased array antenna architecture according to claim 1, wherein a respective one of said plurality of antenna elements distributed on said second side of said multilayer printed circuit wiring board is coupled by means of a plated via through said multilayer printed circuit wiring board to an associated RF signal processing circuit device on said first side of said multilayer printed circuit wiring board.

11. A phased array antenna architecture according to claim 1, wherein a respective one of said plurality of antenna elements distributed on said second side of said multilayer printed circuit wiring board is coupled by means of a glass-surrounded conductor passing through an aperture in said multilayer printed circuit wiring board to an associated RF signal processing circuit device on said first side of said multilayer printed circuit wiring board.

12. A phased array antenna architecture comprising an array of antenna sub-array tiles supported by a grid-configured support structure, a respective sub-array tile containing a multilayer printed circuit wiring board having a laminate of interconnect layers, including control signal and DC voltage distribution conductors that provide control signal interconnectivity and DC power distribution for antenna and RF signal processing circuit devices of said respective sub-array tile, interposed between first and second opposite sides of said board, a plurality of signal processing interface networks, including RF microstrip networks, distributed on said first side of said multilayer printed circuit wiring board, a plurality of RF signal processing circuit devices mounted to and connected by said plurality of signal processing interface networks distributed on said first side of said multilayer printed circuit wiring board to said control signal and DC voltage distribution conductors of said laminate of interconnect layers, and a plurality of antenna elements distributed over said second side of said multilayer printed circuit wiring board, and coupled through said multilayer printed circuit wiring board to associated ones of RF signal processing circuit devices mounted to said plurality of RF signal processing interface networks distributed on said first side of said multilayer printed circuit wiring board.

13. A phased array antenna architecture according to claim 12, further including power supply and control units coupled with said multilayer printed circuit wiring boards, and being operative to supply power to, interface RF signalling with, and control the operation of said tiles.

14. A phased array antenna architecture according to claim 12, wherein a respective one of said plurality of antenna elements distributed on said second side of said multilayer printed circuit wiring board is coupled by means of a plated via through said multilayer printed circuit wiring board to an associated RF signal processing circuit device on said first side of said multilayer printed circuit wiring board.

15. A phased array antenna architecture according to claim 12, wherein a respective one of said plurality of antenna elements distributed on said second side of said multilayer printed circuit wiring board is coupled by means of a glass-surrounded conductor passing through an aperture in said multilayer printed circuit wiring board to an associated RF signal processing circuit device on said first side of said multilayer printed circuit wiring board.

16. A phased array antenna architecture according to claim 12, further including signal processing interface networks distributed on said second side of said multilayer printed circuit wiring boards.

17. A phased array antenna architecture according to claim 12, further including at least one power and control unit supported at first sides of said multilayer printed circuit wiring boards, and being operative to supply power, control signals and RF signals to said tiles.

18. A phased array antenna architecture according to claim 17, wherein said at least one power and control unit is operative to supply said power, control signals and RF signals over a common transmission link, and wherein said plurality of signal processing interface networks are configured to filter out and supply said power, control signals and RF signals to said tiles.

19. A method of configuring a phased array antenna comprising the steps of:

(a) providing a plurality of phased array antenna tiles, a respective phased array antenna tile including a multilayer printed circuit wiring board containing a laminate of interconnect layers, including control signal and DC voltage distribution conductors that provide control signal interconnectivity and DC power distribution for antenna and signal processing circuit devices of said respective phased array antenna tile, interposed between first and second opposite sides thereof, RF signal processing interface networks including RF microstrip networks distributed on said first side of said multilayer printed circuit wiring board, a plurality of RF signal processing circuit devices mounted to and connected by said plurality of RF signal processing interface networks distributed on said first side of said multilayer printed circuit wiring board to said control signal and DC voltage distribution conductors of said laminate of interconnect layers, and a plurality of antenna elements distributed over said second side of said multilayer printed circuit wiring board, and being coupled through said multilayer printed circuit wiring board to associated ones of said plurality of RF signal processing circuit devices mounted to said RF signal processing interface networks distributed on said first side of said multilayer printed circuit wiring board; and (b) attaching said phased array antenna tiles to a grid-configured support structure therefor.

20. A method according to claim 19, wherein step (b) comprises attaching said phased array antenna tiles to a grid-configured support structure that is configured to support said plurality of phased array antenna tiles in an array configuration, and such that said signal processing interface networks distributed on said first side of said multilayer printed circuit wiring board are effectively protected from the environment to which said plurality of antenna elements are exposed.

21. A method according to claim 20, further including the step of:

(c) mounting at least one power and control unit at first sides of said multilayer printed circuit wiring boards, and coupling said at least one power and control unit to multiple ones of said tiles so as to supply power to and control the operation thereof.

* * * * *

UNITED STATES PATENT AND TRADEMARK OFFICE

CERTIFICATE OF CORRECTION

PATENT NO. : 6,166,705
DATED : December 26, 2000
INVENTOR(S) : Mast et al.

It is certified that error appears in the above-identified patent and that said Letters Patent is hereby corrected as shown below:

In the title: Delete: "Multi Title-Configured Phased Array Antenna Architecture"
Insert -- Multi Tile-Configured Phased Array Antenna Architecture --

Signed and Sealed this

Fifteenth Day of May, 2001

*Attest:*

Nicholas P. Godici

NICHOLAS P. GODICI

*Attesting Officer*

*Acting Director of the United States Patent and Trademark Office*